US006704977B1

(12) United States Patent
Chung

(10) Patent No.: US 6,704,977 B1
(45) Date of Patent: Mar. 16, 2004

(54) STRAP BUCKLE

(75) Inventor: Yao-Chu Chung, Taoyuan Hsien (TW)

(73) Assignee: Taiwan Industrial Fastener Corporation (TW)

( * ) Notice: Subject to any disclaimer, the term of this patent is extended or adjusted under 35 U.S.C. 154(b) by 0 days.

(21) Appl. No.: 10/316,906

(22) Filed: Dec. 12, 2002

(51) Int. Cl.[7] ..... A44B 11/25
(52) U.S. Cl. ..... 24/588.12; 24/667; 24/DIG. 42
(58) Field of Search ..... 24/614, 615, 662, 24/666, 667, 701, 698.1, 588.11, DIG. 42

(56) References Cited

U.S. PATENT DOCUMENTS 4,393,556 A * 7/1983 Yuda et al. ..... 24/662
4,398,324 A * 8/1983 Bakker et al. ..... 24/629
4,488,336 A * 12/1984 Ambal ..... 24/316
4,949,436 A * 8/1990 Anscher ..... 24/671
5,974,639 A * 11/1999 Keller ..... 24/662
6,161,265 A * 12/2000 Gallucci et al. ..... 24/614
6,353,978 B1 * 3/2002 Kawahara et al. ..... 24/114.4

* cited by examiner

*Primary Examiner*—James R. Brittain
(74) *Attorney, Agent, or Firm*—Bacon & Thomas, PLLC

(57) ABSTRACT

The buckle is constructed to include a male buckle member and a female buckle member for joining two. The male buckle member includes a hook block at the front bottom side, and the female buckle member includes an opening adapted to receive the hook block of the male buckle member and a springy support suspending in the opening and adapted to push the hook block forwards into engagement with a part of the female buckle member when the user releases the female buckle member after the hook block has been inserted into the opening by force to push the springy support backwards.

5 Claims, 6 Drawing Sheets

STRAP BUCKLE

BACKGROUND OF THE INVENTION

1. Field of the Invention

The present invention relates to a buckle for joining straps and, more particularly, to such a buckle that can smoothly and stably be set into the locking position and, does not hook clothes or any other external bodies accidentally.

2. Description of the Related Art

A variety of buckles are known for use to fasten two straps together. FIGS. 7 and 8 show a buckle for this purpose according to the prior art. According to this design, the buckle B is comprised of a male buckle member B1 and a female buckle member B2. The female buckle member B2 has a front receiving open side B21, two retaining side holes B22, and a longitudinal guide track B211 inside the front receiving open side B21. The male buckle member B1 has a forwardly extended middle guide rod B12, two springy arms B11 bilaterally arranged in parallel at two sides of the middle guide rod B12, two retaining blocks B13 respectively formed integral with the remote end of each of the springy arms B11, and two stop edges B14 respectively formed in between the springy arms B11 and the retaining blocks B13 at an outer side. When fastening the buckle B, insert the middle guide rod B12 of the male buckle member B1 into the longitudinal guide track B211 of the female buckle member B2 to force the retaining blocks B13 and the springy arms B11 into the front receiving open side B21 of the female buckle member B2. When set into position, the retaining blocks B13 are respectively bilaterally forced outwards by the springy power of the springy arms B11 into the retaining side holes B22, keeping the stop edges B14 of the male buckle member B1 respectively stopped at the respective front side edges B221 of the retaining side holes B22, and therefore the male buckle member B1 is prohibited from backward movement relative to the female buckle member B2. This design of buckle is still not satisfactory in function for the drawbacks below:

1. This design of buckle is not suitable for use in a small article (shoe, wrist watch, body belt, etc.). Because the user must squeeze the retaining blocks B13 inwards with the fingers to disengage the stop edges B14 from the front side edges B221 of the retaining side holes B22 when unfastening the buckle B, the buckle members B1 and B2 must have certain dimensions convenient for operation with the fingers.
2. Because the middle guide rod B12 protrudes from the front side of the male buckle member B1 at a distance, it may hook or damage the clothes or other external bodies accidentally.
3. Because the male buckle member B1 and the female buckle member B2 must match each other precisely, the precision requirement is critical, resulting in high manufacturing cost.
4. When fastening the buckle B, the middle guide rod B12 of the male buckle member B1 must be carefully aimed at the longitudinal guide track B211 of the female buckle member B2 before inserting the male buckle member B1 into the female buckle member B2. The user may set the male buckle member B1 into the female buckle member B2 in position after several attempts.

Therefore, it is desirable to provide a buckle for joining two straps that eliminates the aforesaid drawbacks.

SUMMARY OF THE INVENTION

The present invention has been accomplished under the circumstances in view. It is therefore the main object of the present invention to provide a buckle, which is easy to operate. It is another object of the present invention to provide a buckle, which does not hook the clothes or external bodies when unlocked. It is still another object of the present invention to provide a buckle, which can be closely attached to the surface of the article in which it is installed when locked. According to one aspect of the present invention, the male buckle member has a hook block at the front bottom side, and the female buckle member has an opening adapted to receive the hook block of the male buckle member and a springy support suspending in the opening and adapted to push the hook block forwards into engagement with a part of the female buckle member when the user released the female buckle member from the hand after the hook block had been inserted into the opening by force to push the springy support backwards. According to another aspect of the present invention, the female buckle member has a retaining groove provided in a front side within the opening, and the hook block of the male buckle member has a backwardly extended hooked portion adapted to engage the retaining groove of the female buckle member to positively secure the male buckle member to the female buckle member.

DETAILED DESCRIPTION OF THE PREFERRED EMBODIMENT

Figure 1:
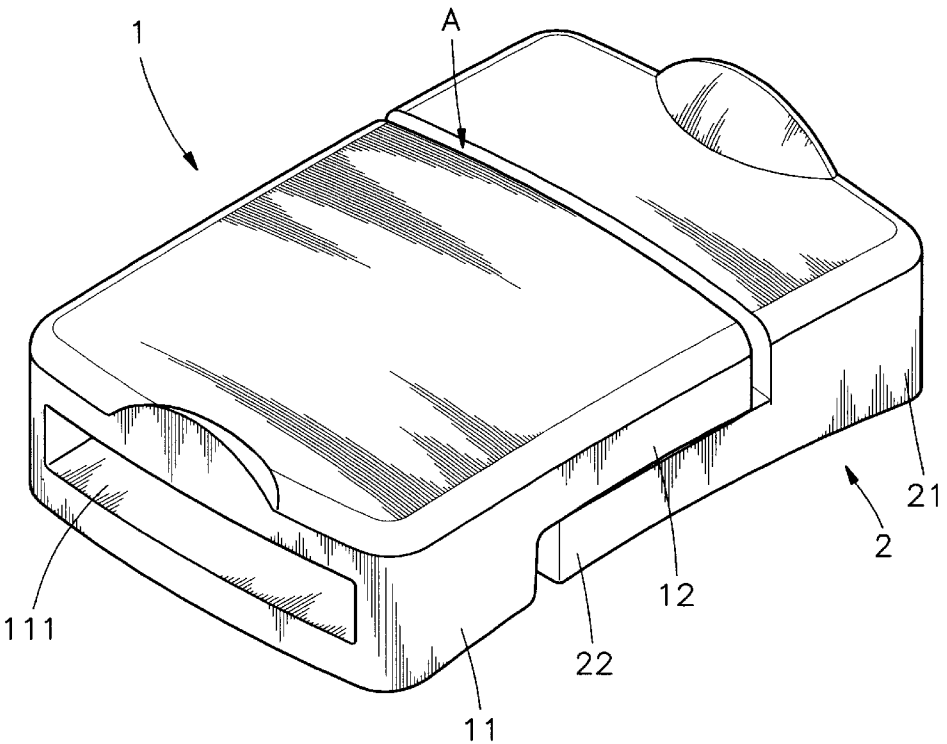
FIG. 1 is an elevational assembly view of a buckle according to the present invention.
Figure 2:
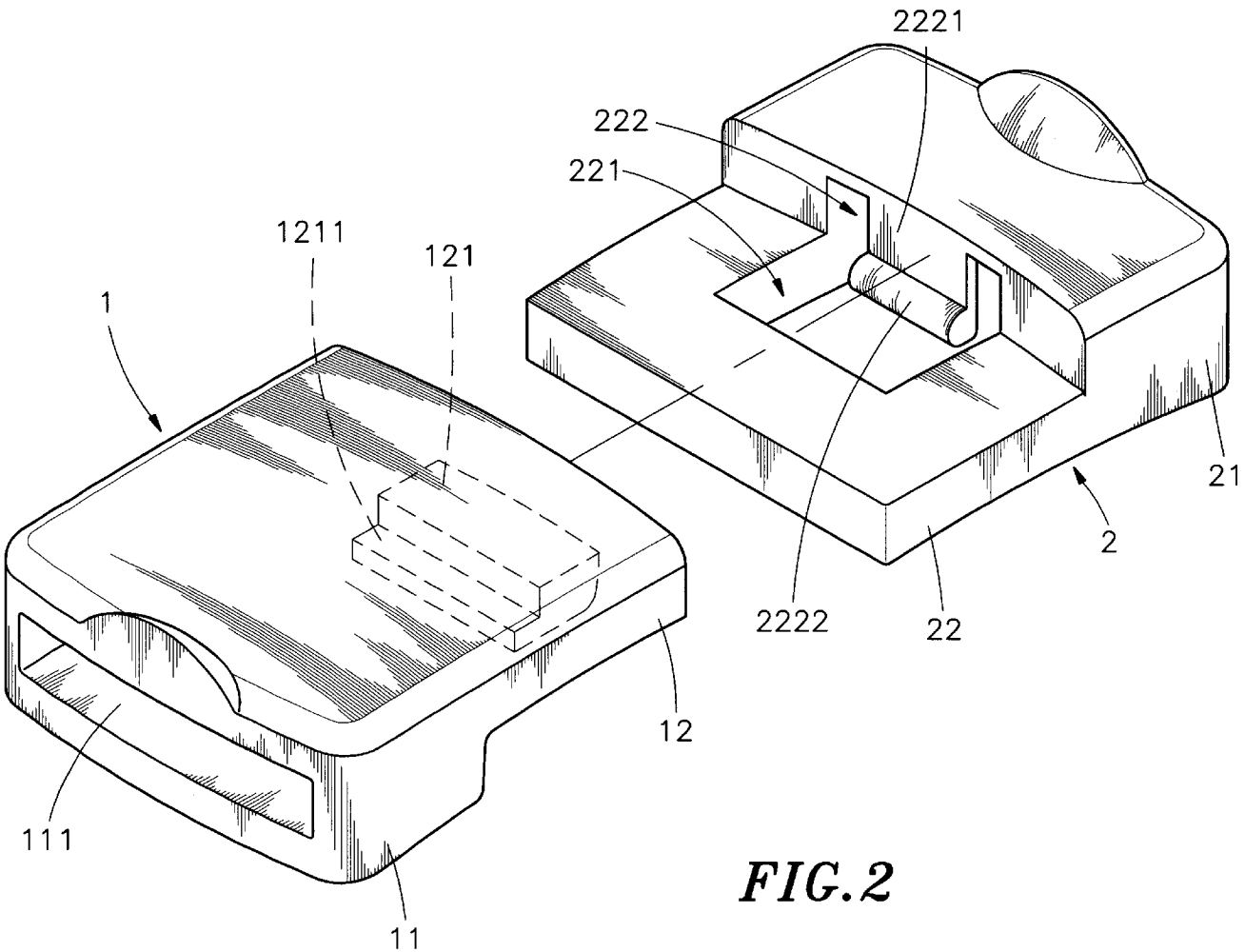
FIG. 2 is a perspective exploded view of the buckle according to the present invention.
Figure 3:
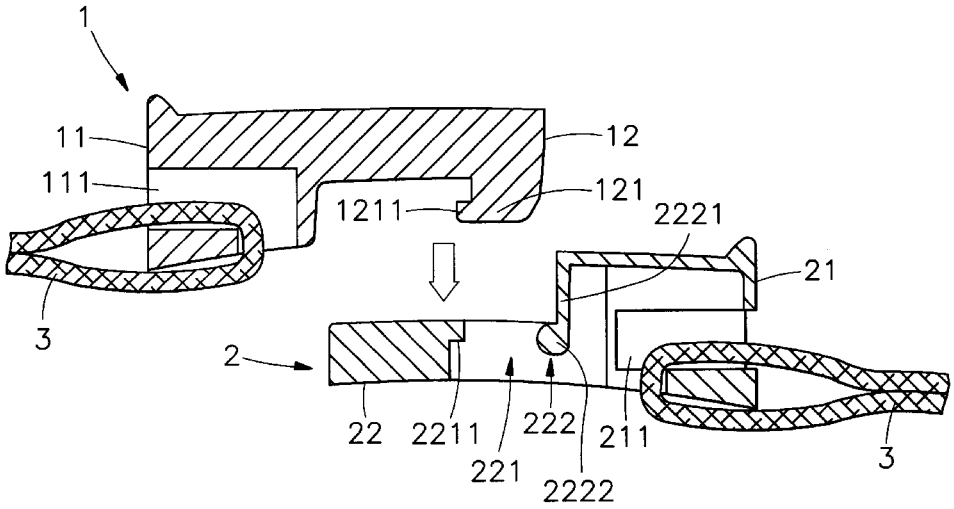
FIG. 3 is a schematic side view in section of the present invention before the connection of the male buckle member to the female buckle member.
Figure 4:
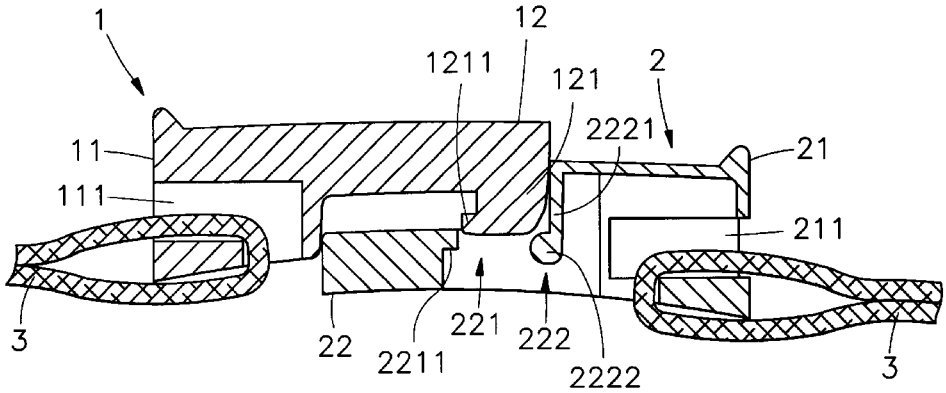
FIG. 4 is similar to FIG. 3 but showing the male buckle member attached to the female buckle member but not set into position.
Figure 5:
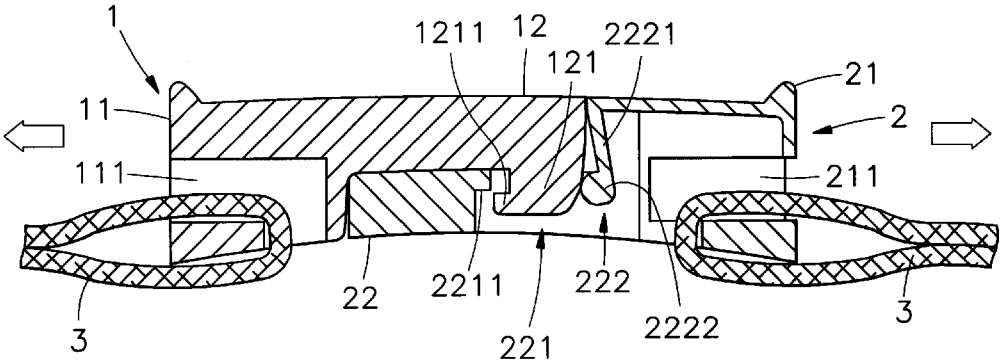
FIG. 5 is similar to FIG. 4 but showing the hook block of the male buckle member set into the opening of the female buckle member.

Referring to FIGS. 1~3, a buckle for joining two straps (or the ends of a strap) in accordance with the present invention is shown comprised of a male buckle member 1 and a female buckle member 2.

The male buckle member 1 comprises a mounting base 11, a flat front coupling portion 12 forwardly extended from the mounting base 11 in flush with the top surface of the mounting base 11, an insertion hole 111 cut through the mounting base 11, and a hook block 121 downwardly extended from the front sidewall of the front coupling portion 12. The hook block 121 has a backwardly protruded bottom hooked portion 1211.

The female buckle member 2 comprises a mounting base 21, a flat front coupling portion 22 forwardly extended from the mounting base 21 in flush with the bottom surface of the mounting base 21, an insertion hole 211 cut through the mounting base 21, an opening 221 cut through the flat front coupling portion 22 and a part of the mounting base 21, a retaining groove 2211 formed in a front side inside the opening 221 remote from the mounting base 21, and a springy support 222 formed integral with the mounting base 21 and suspending in the opening 221 opposite to the retaining groove 2211. The springy support 222 comprises a springy arm 2221 downwardly extended from the top of the mounting base 21 and suspended in the opening 221, and a cylindrical stop block 2222 transversely located on the free end of the springy arm 2221. After strap members 3 have been respectively fastened to the insertion holes 111 and 211 of the buckle members 1 and 2, the buckle members 1 and 2 can be fastened together to join the strap members 3.

Figure 6:
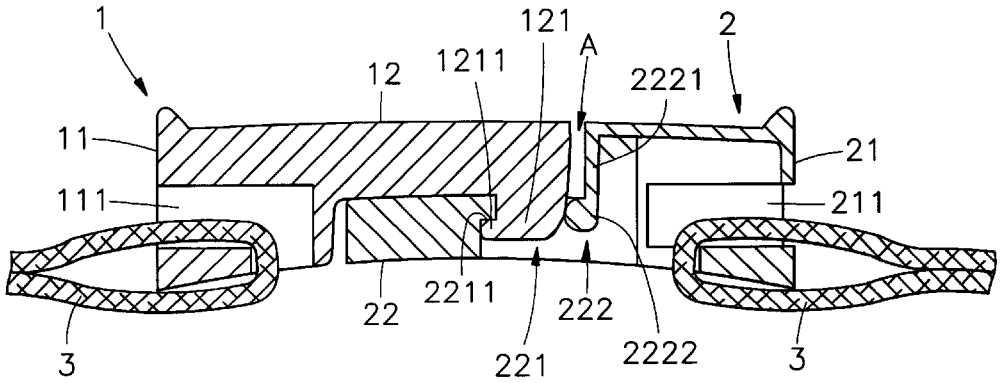
FIG. 6 is similar to FIG. 5 but showing the hooked portion of the hook block of the male buckle member hooked in the retaining groove inside the opening of the female buckle member.
Figure 7:
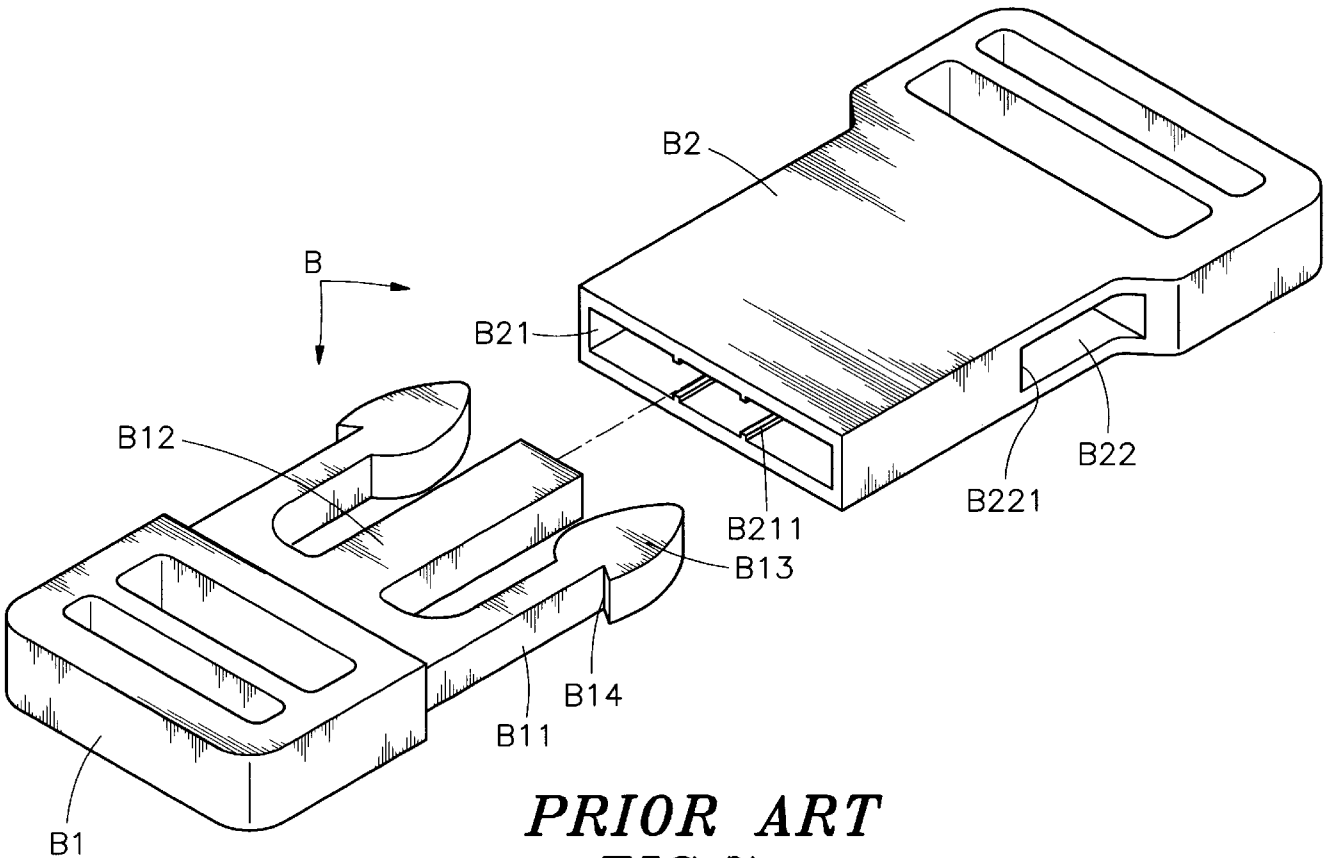
PRIOR ART FIG. 7
FIG. 7 is an exploded view of a buckle according to the prior art.
Figure 8:
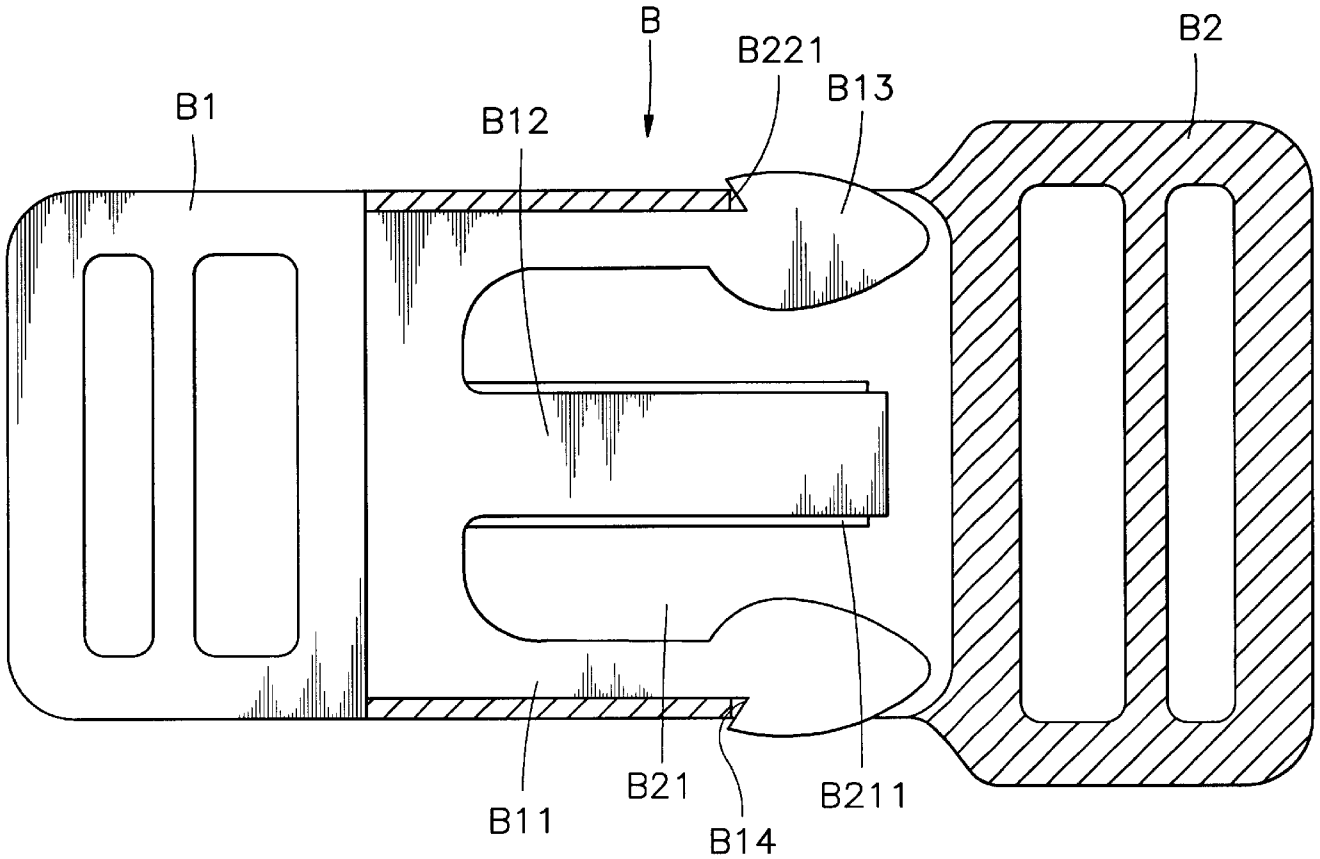
PRIOR ART FIG.8
FIG. 8 is a top view in section of the prior art buckle, showing the male buckle member set into the female buckle member.

The buckle fastening procedure is outlined hereinafter with reference to FIGS. 3~6, the male buckle member 1 is held with one hand, keeping the flat front coupling portion 12 of the male buckle member 1 spaced above the flat front coupling portion 22 of the female buckle member 2 and the hooked block 121 aimed at the opening 221 (see FIG. 3), and then lower the male buckle 1 to force the hook block 121 against the cylindrical stop block 2222 (see FIG. 4) and to push the springy arm 2221 backwards for enabling the hook block 121 to be set into the opening 221 (see FIG. 5), and then release the hand from the female buckle member 1 for enabling the hook block 121 to be pushed backwards by the spring power of the spring arm 2221 to force the hooked portion 1211 into engagement with the retaining groove 2211 (see FIG. 6). When fastened up, a gap A is left between the front sidewall of the flat front coupling portion 12 of the male buckle member 1 and the mounting base 21 of the female buckle member 2 for enabling the user to push the male buckle member 1 forwards against the cylindrical stop block 2222 of the springy arm 2221 to disengage the hooked portion 1211 from the retaining groove 2211, and to further disconnect the male buckle member 1 from the female buckle member.

A prototype of buckle has been constructed with the features of the annexed drawings of FIGS. 1~6. The buckle functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A buckle adapted to join two strap members, comprising:

a male buckle member, said male buckle member comprising a mounting base, a flat coupling portion forwardly extended from a top side of the mounting base of said male buckle member, and a hook block downwardly extended from a front sidewall of the flat coupling portion of said male buckle member;

a female buckle member configured for receiving said male buckle member, said female buckle member comprising a mounting base, a flat coupling portion forwardly extended from a bottom side of the mounting base of said female buckle member and adapted for coupling to the flat coupling portion of said male buckle member, an opening cut through the flat coupling portion of said female buckle member and adapted to receive the hook block of said male buckle member, and a springy support downwardly extends from a top side of the mounting base of said female buckle member and suspends in said opening and is adapted to push said hook block forwards into engagement with a part of said female buckle member when a user releases said female buckle member after said hook block has been inserted into said opening by force to push said springy support backwards; and said springy support comprises a springy arm, said springy arm having a fixed top end connected to the mounting base of said female buckle member and a free bottom end suspended in said opening, and a cylindrical stop block transversely located on the free bottom end of said springy arm.

2. The buckle as claimed in claim 1, wherein the mounting base of said male buckle member has an insertion hole for the mounting of a strap member.

3. The buckle as claimed in claim 1, wherein the mounting base of said female buckle member has an insertion hole for the mounting of a strap member.

4. The buckle as claimed in claim 1, wherein said hook block has a backwardly protruded bottom hooked portion; said female buckle member has a retaining groove formed in a front side inside said opening and adapted to receive the backwardly protruded bottom hooked portion of said hook block.

5. The buckle as claimed in claim 1, wherein a gap is left between the flat coupling portion of said male buckle member and the mounting base of said female buckle member after said male buckle member and said female buckle member fastened up.

* * * * *